United States Patent [19]

Gifford, II

[11] 4,071,434

[45] Jan. 31, 1978

[54] RECOVERY OF OIL FROM TAR SANDS

[75] Inventor: Phillip H. Gifford, II, Bartlesville, Okla.

[73] Assignee: Phillips Petroleum Company, Bartlesville, Okla.

[21] Appl. No.: 718,646

[22] Filed: Aug. 30, 1976

[51] Int. Cl.[2] ..... C10G 1/04; C10B 57/04; C10G 9/00

[52] U.S. Cl. ..... 208/11 LE; 201/20; 208/106

[58] Field of Search ..... 208/11 LE, 11 R, 106; 201/25, 20

[56] References Cited

U.S. PATENT DOCUMENTS

| | | | |
|---|---|---|---|
| 2,885,339 | 5/1959 | Conlson et al. | 208/11 LE |
| 2,910,424 | 10/1959 | Tek et al. | 208/11 LE |
| 3,070,541 | 12/1962 | Price | 208/11 LE |
| 3,466,240 | 9/1969 | Steinmetz | 208/11 LE |
| 3,480,540 | 11/1969 | Eng et al. | 208/11 R |
| 3,553,099 | 1/1971 | Savage et al. | 208/11 LE |

FOREIGN PATENT DOCUMENTS

| | | | |
|---|---|---|---|
| 878,656 | 8/1971 | Canada | 208/11 LE |

*Primary Examiner*—Delbert E. Gantz
*Assistant Examiner*—James W. Hellwege

[57] ABSTRACT

A tar sands slurry containing sand particles of varying sizes dispersed therein is passed into a classifier wherein it is subdivided into at least two streams, each stream containing either coarse or fine solids. The stream containing coarse solids is directed to a separate solids removal zone where the solids are removed. The effluent from the solids removal zone and the fine solid containing stream are then fed to a coking zone.

5 Claims, 1 Drawing Figure

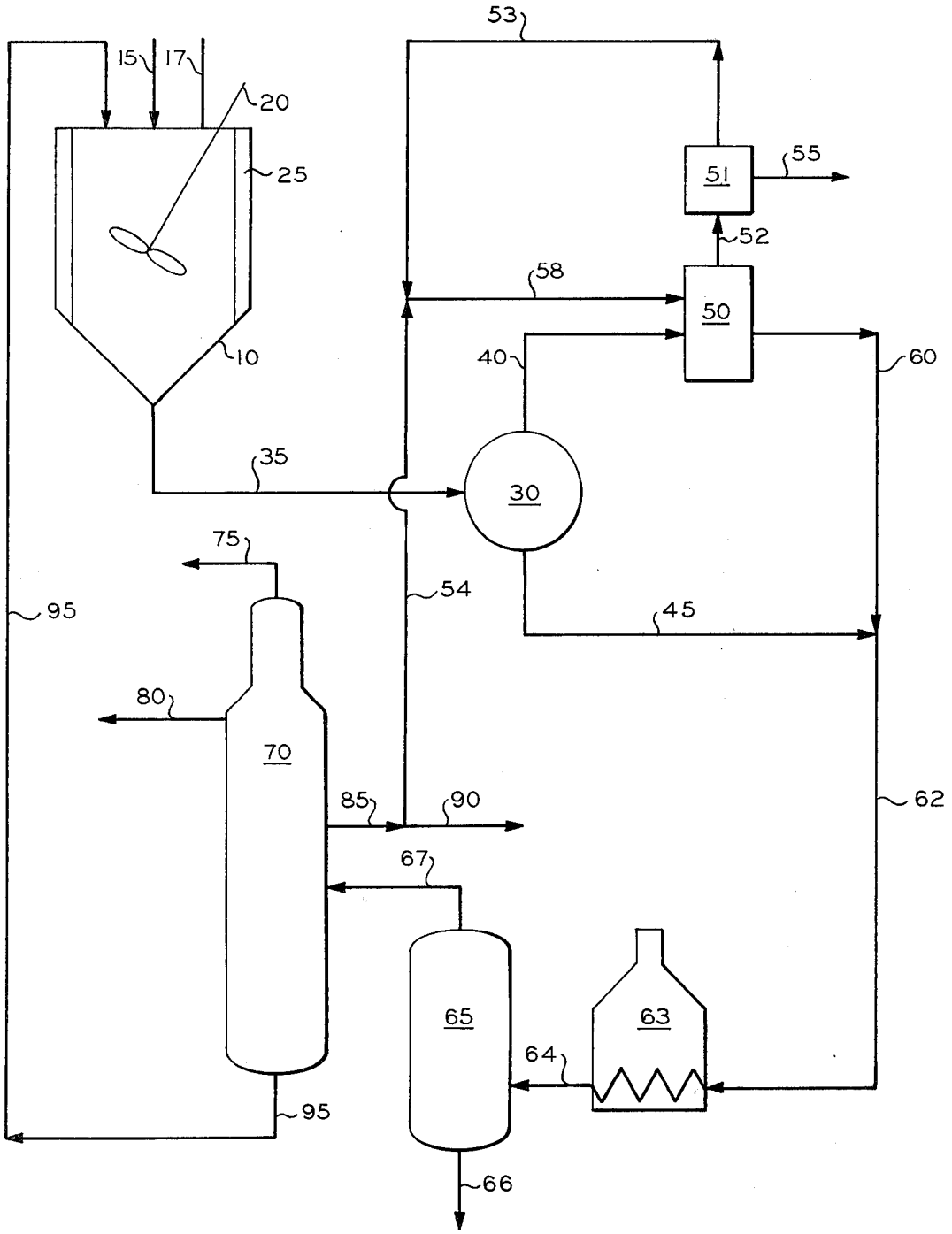
53
15
17
20
25
51
55
52
58
50
10
40
60
35
30
75
54
95
45
80
70
85
90
62
67
65
63
64
95
66

RECOVERY OF OIL FROM TAR SANDS

BACKGROUND OF THE INVENTION

This invention relates to an improved process for the removal of solids of varying sizes from liquid. A particular aspect of the invention relates to the removal of sand from liquid-tar sand slurry in a process for recovery of oil from tar sands.

The removal of solid particles of varying sizes from liquid often requires an expensive and sophisticated process partially because the particles of one size range interfere with the removal of particles of another size range. For example, coarse particles can be removed by passing the liquid containing solid particles through a filtration zone; however, smaller particles tend to accumulate in the filtering zone, restricting the flow of rate and eventually plugging the passageway altogether. Similarily, when fine particles are sought to be removed by passing the liquid through a centrifuge zone the coarse particles' weight and bulk interfere with the process and increase the necessary size of the equipment. The present invention in its broad aspect obviates some of the problems inherent in the removal of solid particles of varying sizes from liquid.

Of particular interest is the application of the present invention to the removal of sand particles from a liquid slurry in a process for the production of oil from tar sands.

Tar sands, also known as oil or bituminous sands, are sands that are heavily impregnated or saturated with oil. Deposits of these sands are found in many areas of the world including Alberta, Canada, Utah and California. Although tar sands provide potentially attractive source of petroleum products, the recovery of valuable components from tar sands in an efficient and economical manner has been a problem. One process for recovery of oil from tar sands disclosed for example in U.S. Pat. No. 2,772,209 and U.S. Pat. No. 3,342,105 comprises adding a diluent to tar sand to form a slurry. The slurry is then heated or introduced into a cyclone as disclosed in U.S. Pat. No. 2,910,424 to achieve separation of oil. One problem encountered by these processes is that tar sand has a high percentage of inorganic solids. The solid particles are of different size ranges so that a complete separation of solids necessitates the use of sophisticated, expensive and energy consuming devices such as centrifuges. A substantially complete removal of solids in a filter zone is impractical because smaller size particles accumulate on the filter restricting the flow rate and resulting in plugging the filter. The expense associated with substantially complete removal of solid particles leads to compromizes in the level the solid removed which in turn results in production of oil having high ash content and therefore not suitable for some applications.

In its particular aspect, this invention obviates some problems encountered in processes for the recovery of oil from tar sands.

Thus, one object of the invention is to provide a process for an efficient removal of solid particles of varying sizes from liquid or from a liquid slurry.

Another object of the invention is to reduce the size and the cost of equipment necessary for the removal of solid particles of varied sizes from a liquid.

Still another object of the invention is to provide a process for recovery of oil from tar sand, which is efficient and results in production of oil having a low ash content.

Still another object of the invention is to provide a process for an efficient and inexpensive removal of solid particles from tar sand slurry.

A still further object of the invention is to utilize fine sand particles contained in tar sand for the production of coke.

Still another object of the invention is to provide a process for production of oil having low ash content from tar sands which eliminates the need for the expensive removal of fine sand from the liquid.

A still further object of the invention is to provide a process for removal of oil from tar sands which does not use water for formation of tar sand slurry, thereby eliminating problems associated with sludge and oil-water emulsion separations.

Still another object of the invention is to provide a method for production of low ash content coke as a by-product in the process for recovery of oil from tar sands.

Other objects of the invention will become apparent to those skilled in the art upon studying this disclosure.

BRIEF DESCRIPTION OF THE DRAWING

The FIGURE depicts the schematic diagram of the prefered embodiment of the process for the recovery of oil from tar sands which utilizes fine solids for the production of coke.

SUMMARY OF THE INVENTION

In accordance with one aspect of the invention, a liquid containing solid particles of varying sizes dispersed therein is passed through a centrifugal classifier zone in which it is subdivided into at least two streams, each of the streams containing solids of different preselected size ranges. Those streams from which removal of the solids is desired are then passed into separate solids removal zones, adapted to remove efficiently solids of selected particle size, where required removal is achieved.

In accordance with another aspect of the invention, an oil-tar sand slurry is separated into two streams, one of which contains coarse sand and the other fine sand. The coarse sand stream is passed through a coarse solids removal zone, such as a filtering or settling zone, whereas the fine sand stream is introduced into a coke. The particles of fine sand serve as nuclei for the formation of coke which is removed together with sand from the system. Overhead vapor from the coker is passed to a fractionator in which it is separated into several products with different boiling ranges such as gas, gasoline, and various oil fractions. The hot bottoms and high boiling oil fractions can be recycled to the tar slurry.

In accordance with another aspect of the invention, a water-tar sand slurry is separated in a classifier zone into at least two streams, each of which contain sand particles of a different size range. Each of the streams is passed through a solids removal zone adapted to remove solids of particular size range corresponding to the size range of particles in the stream introduced thereto. Thus, a stream containing coarse sand can be passed, for example, through a filtration or settling zone whereas a stream containing fine sand can be passed through a centrifuge zone.

Other aspects of the invention will become apparent to those skilled in the art upon studing this specification and the appended claims.

DETAILED DESCRIPTION OF THE INVENTION

Solid particles having varied particle diameters, dispersed in a liquid can be removed efficiently therefrom by first subdividing the solid-liquid slurry into at least two streams, each containing particles of selected size range. Each of those streams that contain solid particles which are sought to be removed are passed through a solid removal zone particularly suited for removal of particles of preselected sizes. For example, coarse particles can be separated from the liquid by passing the liquid through a filtration zone or a settling zone. More sophisticated and expensive equipment, such as centrifuges, is usually required for separation of fine particles; however, since the fine particle stream contains only a fraction of the liquid and a small portion of the solids contained in the original slurry, the overall efficiency of the process is increased and its cost is greatly reduced. Furthermore, in some operations, recovery of particles of certain size range is not necessary, which results in further savings.

Of particular interest is the application of this invention to the removal of sand from a liquid-tar sand slurry in a process for production of oil and coke from tar sand.

The first step of the conventional process for production of oil from tar sand includes mixing the tar sand in a suitable vessel, in the presence or absence of heat, with a suitable liquid such as water or oil to form a slurry. If tar sand contains solid aggregates or clumps, these can be crushed prior to charging the sand to the slurry vessel by any suitable means including ball mill, hammer mill, or jaw crushers. The ratio of liquid to tar sand will vary depending on the type of the liquid, the type of the tar sand, and the desired flow viscosity of the slurry. It is generally preferred to provide a slurry which is easily pumpable. The tar sand suitable for use with this invention includes any tar sands which can form a slurry when mixed with a suitable liquid. Any liquid which forms a slurry, with or without application of heat, when blended with the tar sand can be utilized in this invention; however, in most applications it is preferred to use oil or water.

Upon forming a slurry of a desired flow viscosity, the slurry is passed to a classifier in which it is subdivided into at least two streams, each containing particles of preselected size range. Assuming that only two streams are produced in the subdividing zone—one containing coarse solids and one containing fine solids—each stream is then passed to a distinct removal zone which is especially designed for the removal of particles of selected size range. If removal of particles of certain size range is not required, the removal step in the treatment of that stream can be totally eliminated. The coarse sand, for example, can be removed efficiently in a filtering zone or in a settling zone without interference caused by fine particles. On the other hand, more expensive and complex task of removal of fine particles is carried out more economically due to the reduced overall volume of the liquid, reduced weight and volume of solids, and preselected maximum particle size.

Although this invention can be applied to any process in which a tar sand slurry is formed and then solids are separated therefrom, it is especially useful in a process where oil is utilized to produce the slurry. The slurry is first separated into at least two streams in a classifier, each of the streams containing solid particles of different size range. The streams having coarse sand contained therein are then passed individually into separate sand removal zones. Each zone is particularly designed for the purpose of removing solids in a preselected size range. The stream or streams containing fine sand particles are introduced into a coker where the fine sand particles serve as nuclei for the production of coke. The coke is removed from the coker and the vapors are passed to a fractionator in which these are separated into fractions. Gas and gasoline are removed as overhead products, and low, medium, and high boiling oil fractions are recovered as side-draw products. Bottoms and, if necessary, a portion of high boiling fraction can be recycled to the slurry to serve as a solvent.

In a specific preferred embodiment of this invention depicted in the FIGURE, tar sand and a diluent are introduced into a vessel 10 through 15 and 17, respectively. The diluent can be fractionator bottoms and high boiling oil fractions, but when the process is first initiated gas oil hydrocarbons or diesel fuel can also be utilized. The diluent usually comprises 10–70 percent of the slurry by weight. The ingredients are blended by an agitator 20 and, if necessary, heated by steam passing through a jacket 25. It should be emphasized that heating is not required as long as a slurry of desired flow viscosity can be obtained without it. The preferred temperature of the slurry should be between about 100° and 500° F (38° and 260° C), usually between 250°–400° F (121°–204° C). Once the slurry reaches a viscosity at which it is flowable, it is transported to a classifier 30 via 35. The centrifugal classifier 30 subdivides the slurry introduced therein into two streams 40 and 45, stream 40 containing coarse sand and stream 45 containing fine sand. Although any of a variety of classifiers (described, for example, in "Unit Operations of Chemical Engineering", by W. L. McCabe and J. C. Smith, 2d Edition, pages 930–931, copyright 1967, McGraw-Hill) can be used in connection with this invention, a Dorr-Oliver, Inc. classifier is usually employed.

The choice of the optimum cut diameter ($D_{pc}$) (particles having diameter above which being included in stream 40 and particles having diameter below which being included in stream 45) is determined by the relative ease of separation of the solids from these two resulting streams. For example, if filtration is the mode by which the coarse particle stream 40 is treated and it is found that filtration rates drop off drastically when particles of a diameter less than about 50 microns are included in this stream, then the cut diameter at the centrifugal classifier should be adjusted to a size somewhat larger than 50 microns. Depending upon the specific application, cut diameters could range from as low as about 1 micron to a high of about 100 microns. The resulting weight ratio of solids in the fine solids stream to those in the coarse solids stream are entirely a function of the particle size distribution of the raw material and the optimum cut diameter selected.

Coarse solids are removed from stream 40 in a coarse solids removal zone which comprises a hot oil filter 50 usually operated at temperatures between 300°–500° F (140°–260° C). Light gas oil from the fractionating column 70 is supplied by 54 to the hot oil filter 50 along with recycle light gas oil from the dryer 51 by 53. The sand trapped by the hot oil filter 50 is removed as filter cake and introduced into sand dryer 51 by 52. There light gas oil is separated and the majority thereof is withdrawn by 53 and combined with stream 54 to be recycled to the oil filter 50, but a portion thereof remains with the sand going to the dryer 51 and is removed through 55. The details of the operation of hot oil filters (also referred to as rotary drum filters) can be found, for example, in *Chemical Engineers' Handbook* by Robert H. Perry, 5th Edition, McGraw-Hill (1973).

The stream 45 combines with the filtrate of stream 40 being transported by 60 to form stream 62. The stream 62 is passed to a coking furnace 63, which has an exit temperature in the range from about 800°-1000° F (427°-538° C) and from there to coke drums 65 via 64. There the coke formed around the fine sand as nuclei, is withdrawn by 66, and the vapors are passed via 67 to the mid-section of the fractionating column 70. The details of the coking process can be found, for example, in "Diagram of Delayed Coking Process" by W. L. Nelson, *Petroleum Refinery Engineering,* McGraw-Hill (1958).

The fractionating column 70 is maintained at such temperature and pressure as to separate the material introduced through 67 into overhead product taken off by 75 and comprising mainly gas plus naptha, different cuts of oil taken off through 80, 85, and 90, and liquid bottoms and high boiling oil fractions having boiling temperature over 700° F (371° C) removed through 95 and recycled to the vessel 10. Since the recycle stream 95 is usually at about 700° F (371° C), it is rarely necessary to supply additional heat to the slurry contained in vessel 10, which is usually kept at a temperature from about 100°-500° F (38°-260° C) and preferably 250°-450° F (121°-232° C). In some applications, it may even by necessary to cool the recycle stream 95 before it is introduced into vessel 10.

A portion of the stream 85 comprising light gas oil having boiling points between 450°-700° F (232°-371° C) is withdrawn as product via 90, and a part thereof transported by 54 is combined with stream 53 to form light gas oil wash stream 58 going to hot oil filter 50.

Optionally, the stream 60 containing substantially no solids can be passed alone to the coking furnace 63 and coke drums 65 to produce low ash content coke, an economically desirable product. The stream 45 can then be retained in an appropriate holding tank (now shown) or it can be passed to a different coker unit (not shown), in which coke of higher ash content is produced.

It should be emphasized that many changes and modifications which fall within the scope of this invention can be introduced into the processes. For example, although centrifugal classifier was utilized in the preferred embodiment, any other means of separating the slurry into streams having preselected particle size range is acceptable. Similarly, although hot oil filter was utilized in the removal of coarse sand, decanters, settling tanks, centrifuges, and other equipment can also be used. Furthermore, in some processes a combination of several types of devices can be most economical.

The following calculated example is included to further illustrate the practice of the invention and is not intended to limit in any manner the scope of the invention.

EXAMPLE

In the system as shown in the FIGURE, 50,000 tons per day (TPD) of tar sand containing 11 weight percent of bitumen, 83 weight percent of sand, and 6 weight percent of water is introduced into a melt tank where a slurry is produced with oil recycled from the fractionator at a rate of 50,000 TPD. The slurry comprises 50 weight percent of tar sand and 50 weight percent of recycled oil. The melt tank is maintained at 400° F (204° C) temperature sufficient to evaporate 3,000 TPD of water. The slurry is then passed from the melt tank to a centrifugal classifier. The melt tank stream entering the centrifugal classifier comprises 41,500 TPD of sand and 55,500 TPD of organics (bitumen plus oil). The classifier subdivides the melt tank stream into an overflow stream comprising 8,060 TPD of flow and an underflow stream comprising the remainder of the melt tank stream, 39,010 TPD sand and 49,930 TPD organics. The overflow stream contains 2,490 TPD of sand having diameter equal or less than 44 microns; sand of that diameter comprises about 6 weight percent of the total sand in the slurry. The underflow stream is introduced into a hot oil filter having filter area of 48,000 ft.$^2$ which retains coarse solids so that the filtrate stream leaving the hot oil filter contains 39 TPD solids and 53,371 TPD organics. The solids trapped by the hot oil filter are washed with a light gas oil wash introduced to the filter at the rate of 5,000 TPD. Most of the light gas oil wash is combined with the filtrate stream, but a portion thereof (1,559 TPD) is removed from the hot oil filter together with the sand (38,971 TPD). The filter cake removed from the hot oil filter is introduced into a sand dryer from which 1,520 TPD of light gas oil contained therein is recovered and 38,971 TPD of sand together with 39 TPD of organics are lost from the system. The 1,520 TPD light gas oil stream is recycled to the hot oil filter making up a portion of the 5,000 TPD light gas oil wash stream.

The filtrate stream, comprising 39 TPD solids and 53,371 TPD organics, is introduced into the coking furnace together with the overflow stream from the centrifugal classifier which contains 2,490 TPD of solids and 5,570 TPD or organics and the combined streams are passed therefrom to coke drums. The charge introduced into coke drums is subdivided therein into an overhead stream comprising 57,731 TPD organics and a bottom stream containing 2,529 TPD solids and 1,210 TPD coke. The overhead stream from the coke drums is introduced into a fractionator and the bottom stream is removed as coke. The operating conditions in the fractionator are such that feed introduced thereto is separated into overhead, several intermediate cuts, and bottoms. The bottoms stream comprising heavy gas oil is recycled to the vessel 10 where it is used for making the oil-tar sand slurry. One portion of the intermediate cut (3,480 TPD) having boiling point range about 450°-700° F (232°-371° C) is recycled to the hot oil filer forming a light gas oil wash together with light gas oil recycled from the sand dryer. The other portion of that cut (2,326 TPD) is withdrawn as product.

The following products are recovered from the system:

| Cuts | Wt. Percent | Yield TPD | Product |
|---|---|---|---|
| #1 (overhead) | 5 | 275 | $C_4$ and below gases |
| #2 | 30 | 1650 | Napthas, boiling below 450° F |
| #3 | 43 | 2326 | Light gas oil, boiling |

-continued

| Cuts | Wt. Percent | Yield TPD | Product |
|---|---|---|---|
| | | | points between 450–700° F |
| coke | 22 | 1210 | Coke together with 2529 TPD sand |

I claim:

1. A process for recovery of oil and other valuable components from tar sand which comprises:
   a. introducing into a mixing zone tar sand and a sufficient amount of a solvent to form a flowable slurry;
   b. mixing tar sand and solvent in the mixing zone until a slurry of desired viscosity is produced;
   c. subdividing the slurry produced in step (b) into two streams, a first stream containing coarse solids and a second stream containing fine solids;
   d. passing the said first stream through a solids removal zone to remove the coarse solids therein; and
   e. introducing the first stream, after it has passed through the solids removal zone, and the second stream, still containing the fine solids, into a coking zone to produce vapors and coke.

2. A process for recovery of oil and other valuable components from tar sand which comprises:
   a. introducing into a mixing zone tar sand and a sufficient amount of a solvent comprising a heavy bottoms oil to form a flowable slurry;
   b. mixing tar sand and solvent in the mixing zone until a slurry of desired viscosity is produced;
   c. subdividing the slurry produced in step (b) into two streams, a first stream containing coarse solids and a second stream containing fine solids;
   d. passing the said first stream through a solids removal zone to remove the coarse solids therein;
   e. introducing the first stream, after it has passed through the solids removal zone, and the second stream, still containing the fine solids, into a coking zone to produce vapors and coke;
   f. withdrawing the coke produced in the coking zone;
   g. feeding the vapors produced in the coking zone into a fractionating zone; and
   h. fractionating the liquid vapors to produce gas, gasoline, oil fractions including high boiling fractions, and heavy bottoms oil.

3. A process as claimed in claim 2 further comprising recycling the heavy liquid bottoms oil from the fractionating zone to the mixing zone.

4. A process as claimed in claim 3 wherein passing the first stream through the separation zone includes filtering.

5. A process as claimed in claim 3 wherein passing the first stream through the separation zone includes allowing the coarse sand to settle.

* * * * *